US006525470B1

(12) United States Patent
Amemiya

(10) Patent No.: US 6,525,470 B1
(45) Date of Patent: Feb. 25, 2003

(54) PLASMA DISPLAY PANEL HAVING A PARTICULAR DIELECTRIC STRUCTURE

(75) Inventor: Kimio Amemiya, Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/285,057

(22) Filed: Apr. 2, 1999

(30) Foreign Application Priority Data

Apr. 14, 1998 (JP) ..... 10-119988

(51) Int. Cl.[7] ..... H01J 17/49

(52) U.S. Cl. ..... 313/586; 313/584; 313/587; 313/493

(58) Field of Search ..... 313/586, 584, 313/582, 581, 473, 587, 493

(56) References Cited

U.S. PATENT DOCUMENTS 3,896,327 A * 7/1975 Schermerhorn ..... 313/485
5,703,437 A * 12/1997 Komaki ..... 313/587
5,736,815 A * 4/1998 Amemiya ..... 313/586
5,952,782 A * 9/1999 Nanto et al. ..... 313/584
5,977,708 A * 11/1999 Amatsu et al. ..... 313/586
6,084,349 A * 7/2000 Ueoka et al. ..... 313/587
6,255,780 B1 * 7/2001 Komaki et al. ..... 313/586

FOREIGN PATENT DOCUMENTS

JP 54-158859 A * 12/1979
JP 56-120052 A * 9/1981
JP 57-67262 A * 4/1982

* cited by examiner

*Primary Examiner*—Vip Patel
*Assistant Examiner*—Kevin Quarterman
(74) *Attorney, Agent, or Firm*—Arent Fox Kintner Plotkin & Kahn, PLLC

(57) ABSTRACT

A plasma display panel has a pair of substrates, a pair of opposed row electrodes disposed adjacently to the display side substrate interposed by a discharge gap, and a dielectric layer covering the row electrodes. The dielectric layer is formed except in the discharge space, thereby forming a vacant space or groove in the discharge gap.

3 Claims, 9 Drawing Sheets

PLASMA DISPLAY PANEL HAVING A PARTICULAR DIELECTRIC STRUCTURE

BACKGROUND OF THE INVENTION

The present invention relates to a plasma display panel (PDP) of an AC driven surface discharge type.

Recently, there is expectation of realization of the AC driven surface discharge type PDP as a large and thin color display.

FIG. 15 shows a conventional PDP of the AC driven surface discharge type. The PDP comprises a pair of front and back glass substrates 1 and 6 disposed opposite to each other, interposing a discharge space 8 therebetween. The glass substrate 1 as a display portion has a plurality of row electrodes X and Y which are alternately disposed in pairs to be parallel with each other at the inside portion thereof. The row electrodes X and Y are covered by a dielectric layer 4. A protection layer 5 made of MgO is coated on the dielectric layer 4. Each of the row electrodes X and Y comprises a transparent electrode film 2 formed by an ITO having a large width and a metallic electrode (bass electrode) 3 formed by a metallic film having a small width and layered on the transparent electrode 2 for compensating the conductivity of the film 2.

On the glass substrate 6, a plurality of data electrodes D are formed to intersect the row electrodes X and Y on the glass substrate 1. A fluorescent layer 7 covers the data electrodes D. The discharge space 8 is filled with rare gas consisting of neon mixed with xenon. Thus, a pixel cell is formed at the intersection of the row electrodes in pairs and the data electrode.

The dielectric layer 4 is formed by applying glass paste having a low melting point on the X, Y electrodes and by baking it. The metallic electrode 3 is formed by aluminum or aluminum alloy or silver.

In the conventional AC-PDP, the row electrodes X, Y are positioned on the same plane. Therefore, when a potential difference is given between the electrodes, a potential distribution E in the discharge space 8 becomes ununiform as shown in FIG. 16. As a result, there occurs problems that the strength of the electric field in the discharge space reduces, so that the discharge starting voltage becomes high.

In addition, the row electrodes are liable to be influenced by the potential of address electrode and the height of rib, thereby the operation becomes unstable.

SUMMARY OF THE INVENTION

An object of the present invention is to provide a plasma display panel the discharge starting voltage of which is reduced, thereby increasing the reliability of the display.

According to the present invention, there is provided a plasma display panel having a pair of substrates, a pair of opposed row electrodes disposed inside the display side substrate interposed by a discharge gap, and a dielectric layer covering the row electrodes, wherein the dielectric layer is formed except the discharge space, thereby forming a vacant space in the discharge gap.

The display side substrate has a groove corresponding to the vacant space.

The display panel has a medial layer on the underside of the display side substrate, and a groove is formed corresponding to the vacant space.

One of the row electrodes has an island shape.

The vacant space may be independent at every pixel cell divided by opposite partitions.

A plurality of vacant spaces may be provided between the row electrodes.

These and other objects and features of the present invention will become more apparent from the following detailed description with reference to the accompanying drawings.

DETAILED DESCRIPTION OF THE PREFERRED EMBODIMENT

Figure 1:
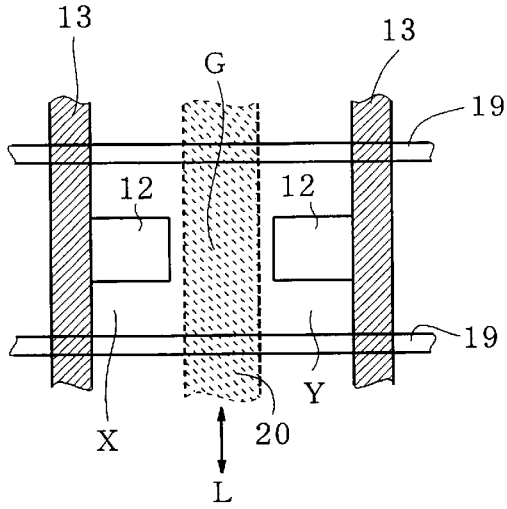
FIG. 1 is a plan view of a part of display in a first embodiment of the present invention.

Referring to FIG. 1, each of row electrodes X and Y comprises a body portion extending in a display line L and a projection extending from the body portion opposite to adjacent projection interposed by a discharge gap G. The body portion is composed of a metallic electrode 13 of a metallic film, and the projection is composed of an island transparent electrode 12 of a transparent conductive film (ITO). The transparent electrode 12 is electrically connected to the metallic electrode 13 at a base portion thereof.

A pair of partitions 19 intersecting with row electrodes partition a discharge space 18 (FIG. 2) to form a pixel cell.

A portion 20 surrounded by dotted line between projections is a portion in which a dielectric layer, which will be described hereinafter, is not formed.

Figure 2:
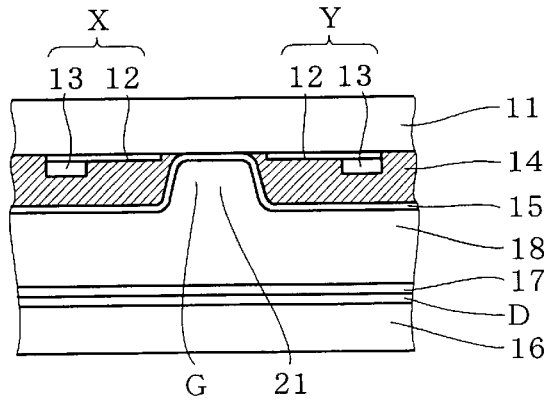
FIG. 2 is a sectional view of the display of FIG. 1.

Referring to FIG. 2, a pair of front and back glass substrates 11 and 16 are disposed opposite to each other, interposing a discharge space 18 therebetween. The glass substrate 11 as a display portion has a plurality of row electrodes X and Y which are alternately disposed in pairs. The row electrodes X and Y are covered by a dielectric layer 14. A protection layer 15 made of MgO is coated on the dielectric layer 14. The dielectric layer 14 is not formed in the discharge gap G. Therefore there is formed a vacant space 21, without dielectric layer in the discharge gap.

On the glass substrate 16, a plurality of data electrodes D are formed to intersect the row electrodes X and Y on the display side glass substrate 11. A fluorescent layer 17 covers the data electrodes D. The discharge space 18 is filled with rare gas. Thus, a pixel cell is formed at the intersection of the row electrodes in pairs and the data electrode.

Figure 3:
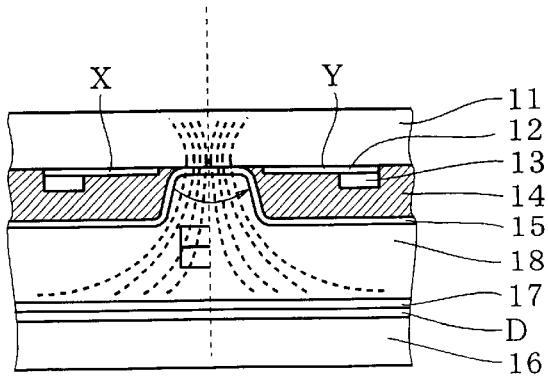
FIG. 3 is an illustration for showing potential distribution.

Since the dielectric layer 14 is not formed in the vacant space 21, the discharge gap G in the discharge space approaches the row electrodes X and Y. In addition, the transparent projection 12 has a small width, so that the strength of the electric field between opposite electrodes is strengthened. Therefore when a voltage is applied to the row electrodes X and Y. electric force lines appear in the discharge space 18, which electric force lines exist in the dielectric layer in the conventional display. Thus, an electric field E generates around the projections of the row electrodes X and Y as shown in FIG. 3, and equal potential lines are distributed shown by dotted lines, the density of the equal potential line is accordingly high in the discharge gap G as illustrated. Therefore, the strength of the electric field in the discharge gap G in the discharge space 18 is increased, so that it is possible to reduce the discharge start voltage.

Since the partition 19 is provided between the protection layer 15 and the fluorescent layer 17, the vacant space 21 is not closed by the partition 19, which communicates the pixel cell with the adjacent cell. If the transparent electrode is provided to extend to the partition 19, the electrode causes an error discharge in the adjacent cell. However, in the embodiment, since the transparent electrode is a projection in the form of island, such an error discharge does not occur.

Although, in the above described first embodiment, the dielectric layer 14 is not formed in a predetermined area of the discharge gap G, the thickness of the dielectric layer in the predetermined area may be made smaller than other areas, thereby forming a recess in the dielectric layer.

Figure 4:
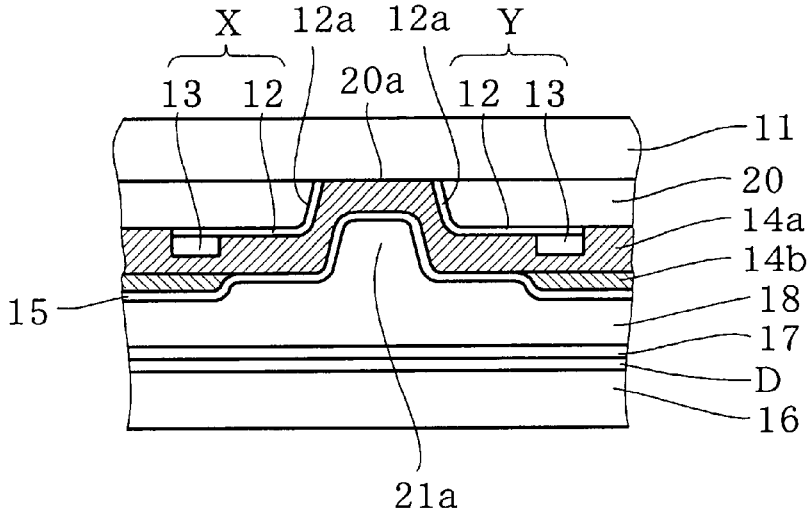
FIG. 4 is a sectional view of a second embodiment of the present invention.
Figure 5:
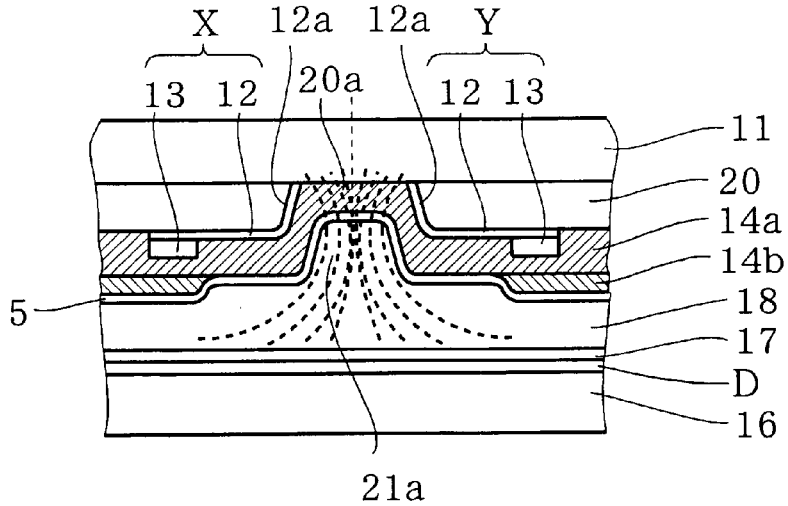
FIG. 5 is an illustration for showing potential distribution in the display of FIG. 4.

Referring to FIGS. 4 and 5 showing the second embodiment of the present invention, there is provided a transparent medial layer 20 having a groove 20*a* with a width approximately equal to the width of the discharge gap G. The transparent medial layer 20 comprises a low melting point glass layer formed on the front glass substrate 11 by etching to form the groove 20*a*. There is formed a vacant space 21*a* corresponding to the groove 20*a*. Therefore, the capacity of the vacant space is increased.

Since the side walls 12*a* of the transparent electrodes 12 are opposed, the potential distribution between the side walls 12*a* is uniform as shown in FIG. 5. Since the discharge starts from the opposite portions, it is possible to reduce the discharge starting voltage. The potential distribution is scarcely influenced by the height of the partition and the address potential so that the discharge characteristic becomes stable.

Since the second dielectric 14*b* is projected, it is possible to prevent unnecessary expansion of the discharge, thereby preventing the error discharge in an adjacent discharge cell.

The third embodiment will be described with reference to FIGS. 6 and 7.

A front glass substrate 11 a has a groove 23 having a width approximately equal to that of the discharge gap G. The opposite side walls 12*a* are attached to the inside walls of the groove 23. The projection (transparent electrode 12) has a wide width portion near the discharge gap G and a narrow width portion. The dielectric layer 14 is formed to cover the row electrodes X and Y except the bottom 23*b* of the groove 23.

Figure 6:
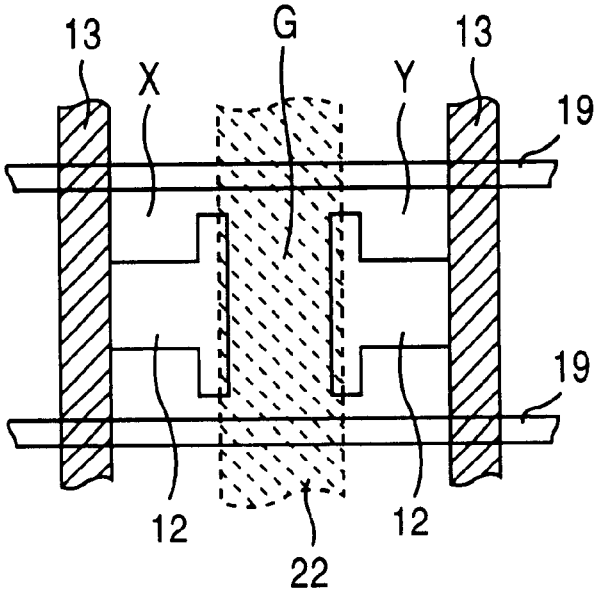
FIG. 6 is a plan view of a third embodiment of the present invention.
Figure 7:
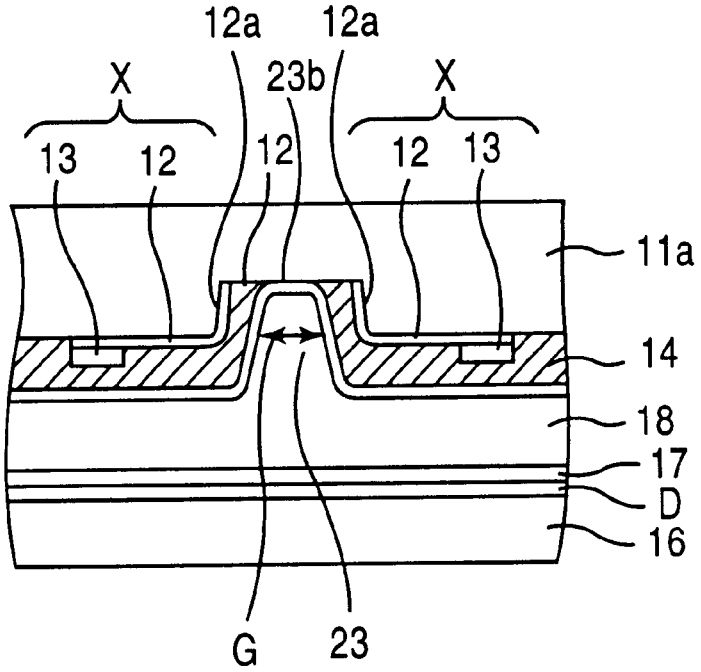
FIG. 7 is a sectional view of FIG. 6.

In FIG. 6, a portion 22 shown by dotted line corresponds to the groove 23.

Since the bottom 23*b* is not coated with the dielectric layer 14, the gap G is expanded. Accordingly, the discharge starting voltage can be more reduced compared with the second embodiment. Furthermore, since the transparent electrode 12 has a T-shape, namely the wide width portion and narrow width portion, the discharge current can be decreased, keeping a low voltage for starting the discharge.

Figure 8:
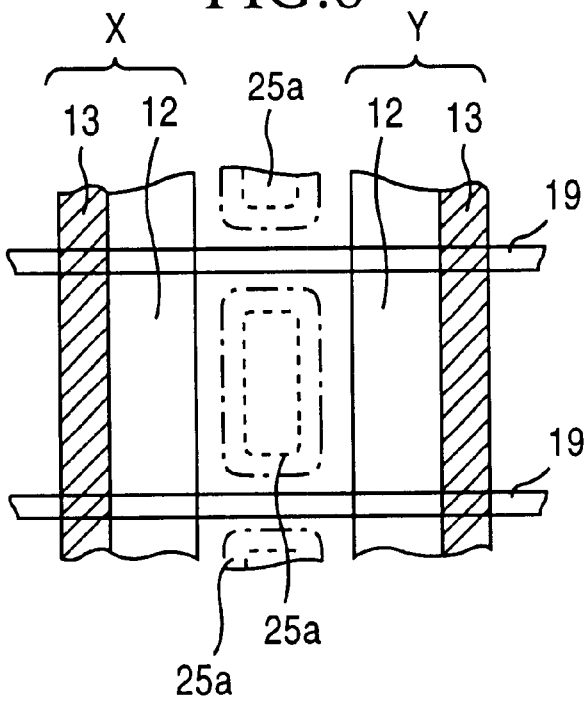
FIG. 8 is a plan view of a fourth embodiment of the present invention.
Figure 9:
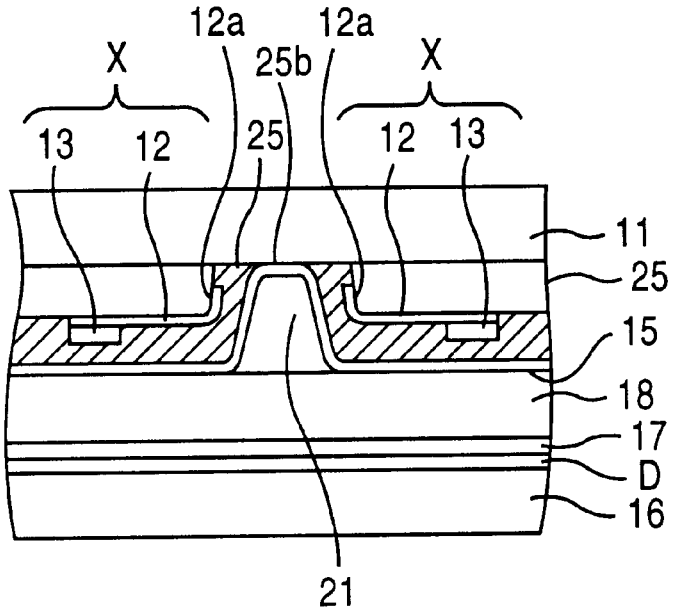
FIG. 9 is a sectional view of FIG. 8.

Referring to FIGS. 8 and 9 showing the fourth embodiment, a transparent medial layer 25 is provided as the second embodiment. The medial layer 25 has a groove 25*a* in each pixel cell between partitions 19. The transparent electrode 12 has a wide width and extends the entire length of the display together with the metallic electrode 13. The metallic electrode 13 has a narrow width sufficient for compensating the conductivity of the transparent electrode 12. Side walls 13*a* are opposed each other at the groove 25*a*. The dielectric 14 covers the row electrodes X and Y except a bottom 25*b*.

Since the groove 25*a* is formed at every pixel cell, the vacant space 21 does not communicate adjacent pixel cells. The error discharge does not occur in the adjacent cells, although the transparent electrode 12 is formed into a strip and extended between cells.

Figure 10:
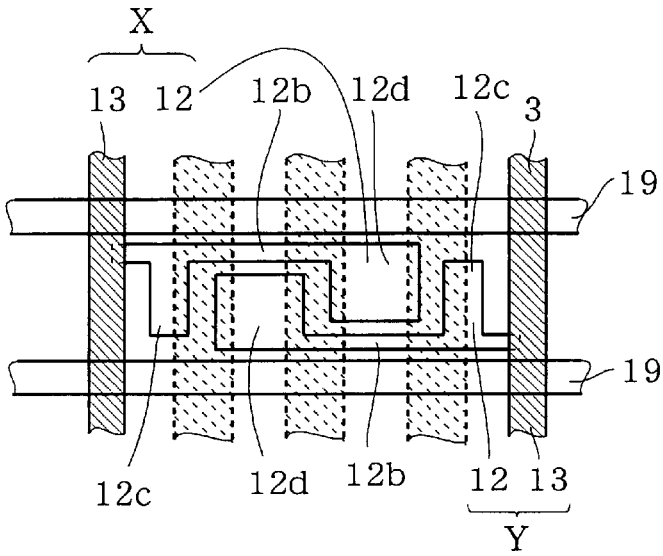
FIG. 10 is a plan view of a fifth embodiment of the present invention.
Figure 11:
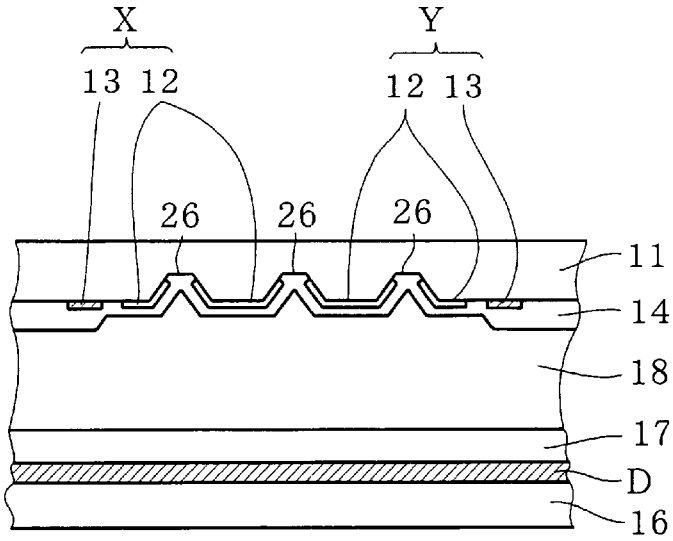
FIG. 11 is a sectional view of FIG. 10.

Referring to FIGS. 10 and 11 showing the fifth embodiment, there is three grooves 26 between the metallic electrodes 13. The transparent electrode 12 comprises a first portion 12*b* projecting from each metallic electrode 13 in the direction (first direction) perpendicular to the metallic electrode extending direction and a second portion 12*c* and a third portion 12*d* projected from the first portion 12*b* in the metallic electrode extending direction.

The second portion 12*c* of the electrode X and the third portion 12*d* of the electrode Y are opposed at the discharge gap G, the third portion 12*d* of the electrode X and the third portion 12*d* of the electrode Y are opposed, and the third portion 12*d* of the electrode X and the second portion 12*c* of the electrode Y are opposed each other at the gap G.

In accordance with the fifth embodiment, a plurality of opposed portions of the electrodes X and Y are provided, so that the light emitting area increases, thereby providing the reduction of the luminance.

Figure 12:
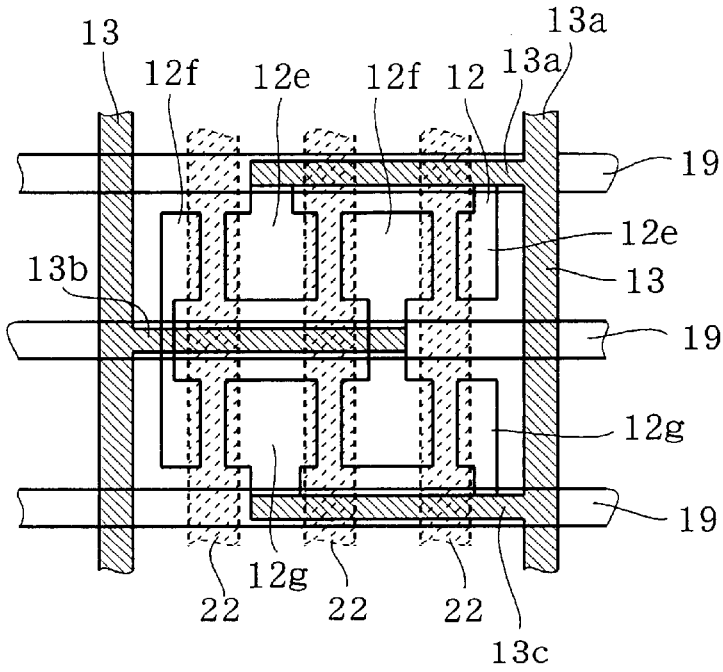
FIG. 12 is a plan view of a sixth embodiment of the present invention.
Figure 13:
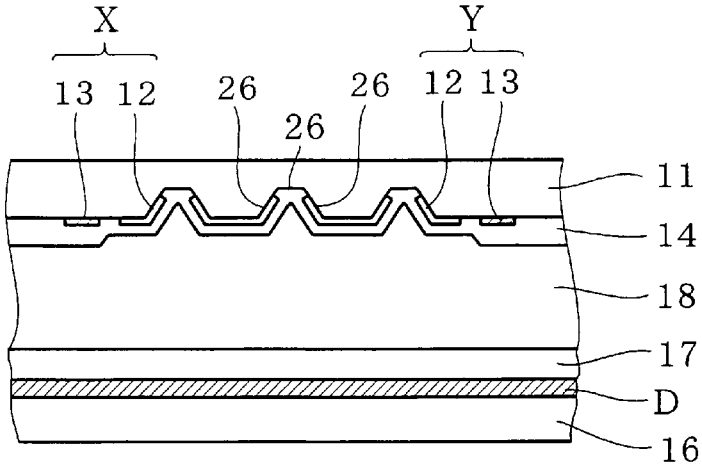
FIG. 13 is a sectional view of FIG. 12.

The sixth embodiment will be described with reference to FIGS. 12 and 13. The same parts as FIGS. 10 and 11 are identified with the same reference numerals as FIGS. 10 and 11, and the description thereof is omitted.

In the embodiment, the row electrodes X and Y are disposed over two pixel cells. The metallic electrodes 13 has projections 13*a*, 13*b*, 13*c* which are alternately projected along the partitions 19.

Transparent electrode 12 comprises electrodes 12*e* projected from projection 13*a*, electrodes 12*f* projected from projection 13*b*, and electrodes 12*g* projected from projection 13*c*.

The operation and advantage are the same as the fifth embodiment.

Figure 14:
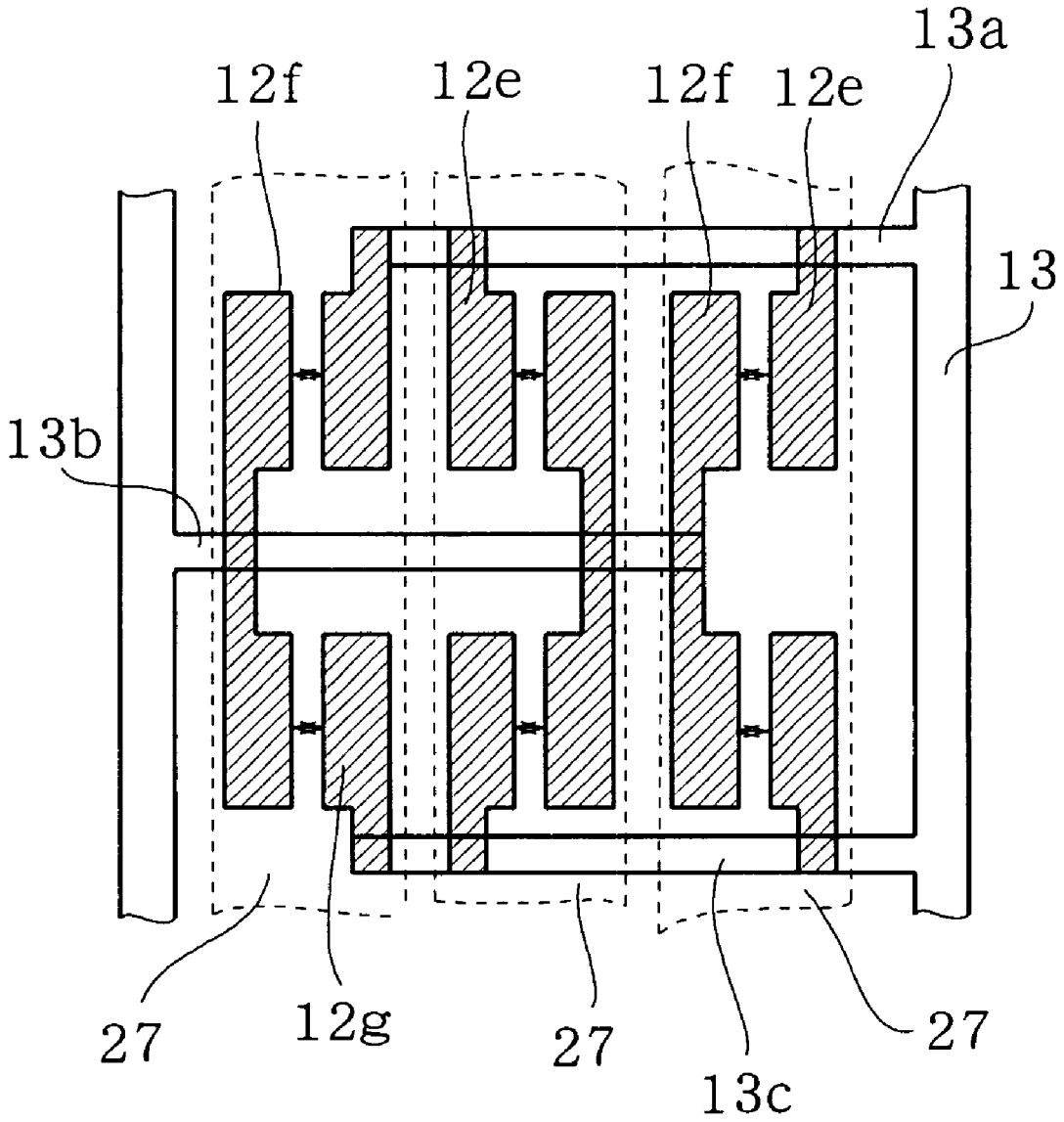
FIG. 14 is a plan view of a seventh embodiment of the present invention.
Figure 15:
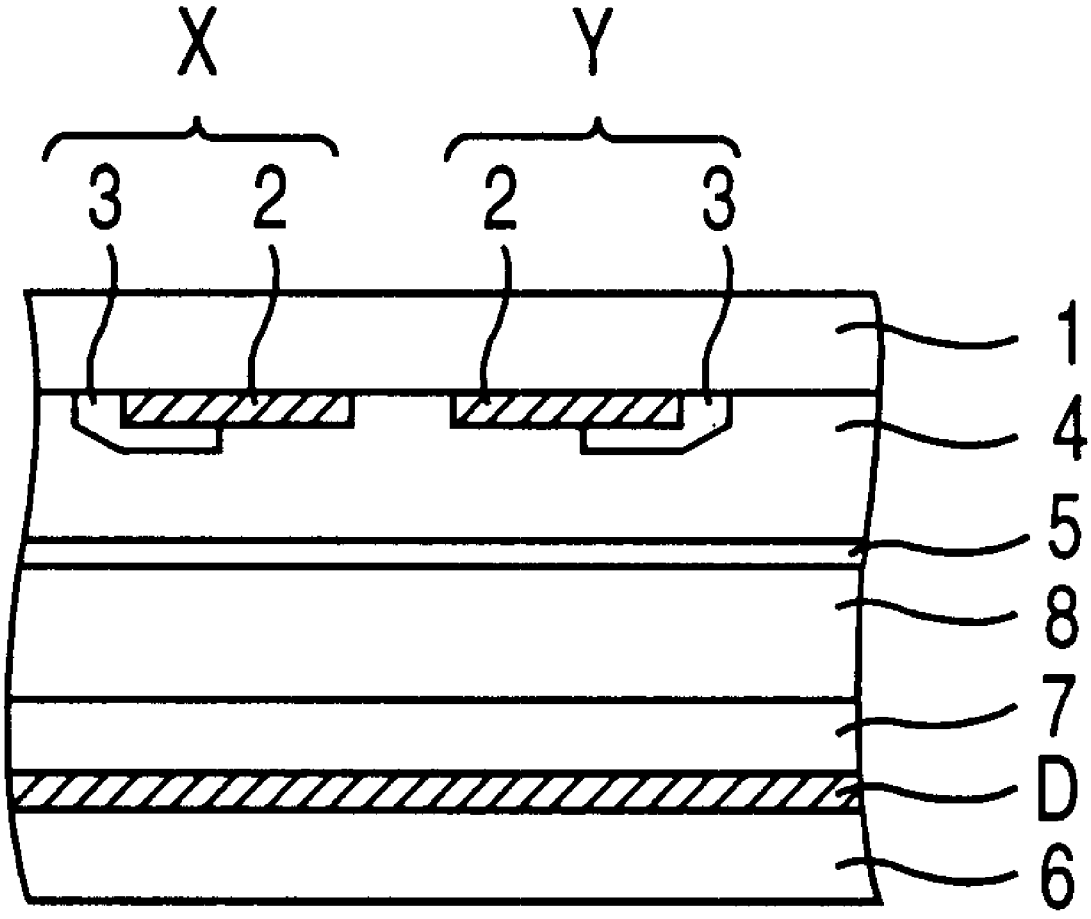
FIG. 15 PRIOR ART
FIG. 15 is a sectional view of a conventional PDP.
Figure 16:
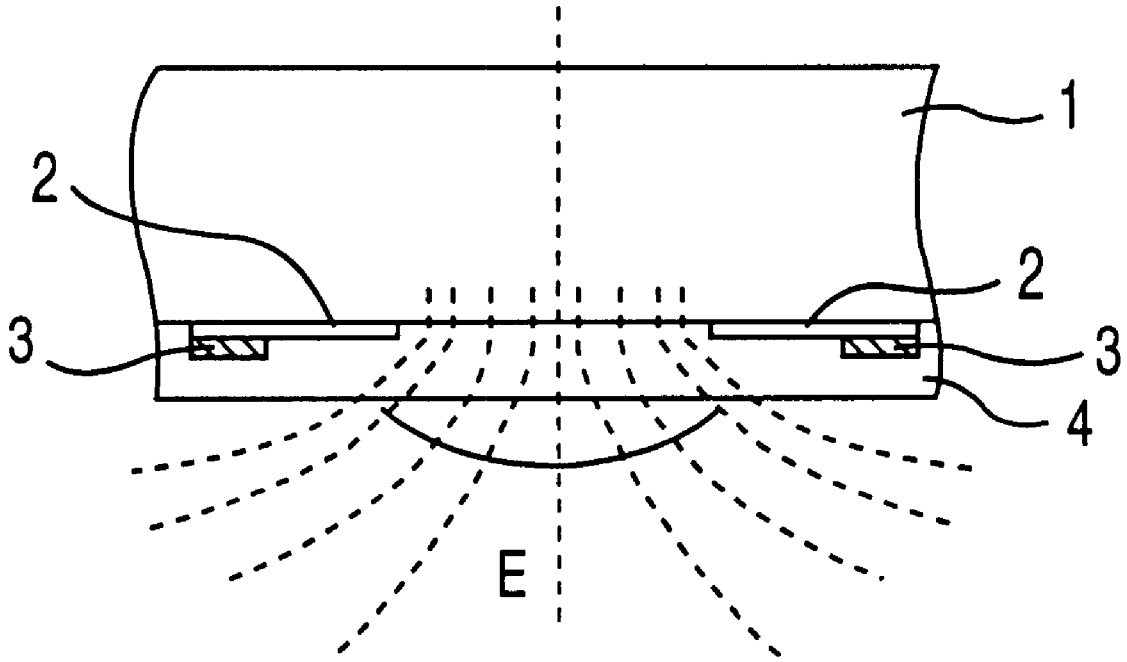
FIG.16 PRIOR ART
FIG. 16 is an illustration for explaining potential distribution of the display of FIG. 14.

Referring to FIG. 14 showing the seventh embodiment, three grooves 27 each having a wide width are formed in the front glass substrate. Each projections 12*e* to 12*g* is mounted on the opposite inside walls of the corresponding groove. Other compositions are the same as the sixth embodiment.

In accordance with the present invention, there is provided a vacant space without a dielectric layer in the discharge space. Therefore, the electric force lines existed in the dielectric layer in the conventional display appear in the vacant space, so that the strength of the electric field in the vacant space is increased, thereby reducing the discharge start voltage.

While the invention has been described in conjunction with preferred specific embodiment thereof, it will be understood that this description is intended to illustrate and not limit the scope of the invention, which is defined by the following claims.

What is claimed is:

1. A plasma display panel comprising:

a display side substrate and a backside substrate opposed through a discharge space;

a pair of row electrodes disposed adjacently to the display side substrate and interposed by a discharge gap portion;

a dielectric layer covering the row electrodes up to the discharge space; and a plurality of data electrodes extending in a direction perpendicular to the row electrodes and disposed adjacently to the backside substrate for forming a discharge cell at each intersecting portion with the corresponding pair of row electrodes;

characterized in that:

said row electrodes comprise body portions extending in a direction of the row electrodes and projections extending from the body portion in a direction of the data electrodes, the projections having tip portions and being opposed through the discharge gap portion to each other;

a groove is provided in said discharge gap portion adjacent to said display side substrate, said groove forming a part of said discharge space; and each tip portion of said projections extends along each side wall of said groove in a direction of said display side substrate.

2. The plasma display panel according to claim 1, wherein said groove is directly formed in said display side substrate.

3. The plasma display panel according to claim 1, further including:

a transparent medial layer provided between said display side substrate and said row electrodes;

wherein said groove is formed in said transparent medial layer.

* * * * *